US008567890B2

(12) United States Patent
Ito et al.

(10) Patent No.: US 8,567,890 B2
(45) Date of Patent: Oct. 29, 2013

(54) METHOD FOR CONTROLLING DROPLET DISCHARGE DEVICE AND DROPLET DISCHARGE DEVICE

(75) Inventors: Tatsuya Ito, Nagano (JP); Yuji Iwata, Nagano (JP); Osamu Kasuga, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 495 days.

(21) Appl. No.: 12/786,798

(22) Filed: May 25, 2010

(65) Prior Publication Data

US 2010/0302296 A1 Dec. 2, 2010

(30) Foreign Application Priority Data

May 28, 2009 (JP) ..... 2009-128599
Apr. 14, 2010 (JP) ..... 2010-092914

(51) Int. Cl.
*B41J 29/38* (2006.01)

(52) U.S. Cl.
USPC ..... 347/14

(58) Field of Classification Search
USPC ..... 347/14
See application file for complete search history.

(56) References Cited

U.S. PATENT DOCUMENTS 6,502,914 B2 * 1/2003 Hosono et al. ..... 347/11
2006/0023031 A1 * 2/2006 Alfekri et al. ..... 347/60
2009/0295858 A1 12/2009 Ito et al.
2009/0303274 A1 12/2009 Iwata et al.
2009/0303275 A1 12/2009 Ito et al.

FOREIGN PATENT DOCUMENTS

JP 2003-21714 A 1/2003
JP 2009-183866 A 8/2009
JP 2009-285546 A 12/2009
JP 2009-288278 A 12/2009
JP 2009-291757 A 12/2009
JP 2009-294350 A 12/2009

* cited by examiner

*Primary Examiner* — Uyen Chau N Le
*Assistant Examiner* — Kajli Prince
(74) *Attorney, Agent, or Firm* — Global IP Counselors, LLP

(57) ABSTRACT

A method is for controlling a droplet discharge device including at least a droplet discharge head having a plurality of nozzles for discharging droplets of a functional liquid, a plurality of drive elements provided corresponding to each of the nozzles, and a vibrating plate which is vibrated by the drive elements to discharge the functional liquid from the nozzles; and a flushing unit in which the vibrating plate undergoes microvibration when the droplet discharge head is in a standby period. The method for controlling a droplet discharge device includes selecting one of a plurality of predetermined microvibration control programs for causing the vibrating plate to undergo microvibration in accordance with information relating to the functional liquid, and controlling the drive elements to cause the vibrating plate to undergo microvibration when the droplet discharge head is in the standby period in accordance with the selected microvibration control program.

8 Claims, 5 Drawing Sheets

METHOD FOR CONTROLLING DROPLET DISCHARGE DEVICE AND DROPLET DISCHARGE DEVICE

CROSS-REFERENCE TO RELATED APPLICATIONS

This application claims priority to Japanese Patent Application No. 2009-128599 filed on May 28, 2009 and Japanese Patent Application No. 2010-092914 filed on Apr. 14, 2010. The entire disclosures of Japanese Patent Application Nos. 2009-128599 and 2010-092914 are hereby incorporated herein by reference.

BACKGROUND

1. Technical Field

The present invention relates to a method for controlling a droplet discharge device and to a droplet discharge device, and specifically relates to a control performed during standby of a droplet discharge head.

2. Related Art

Droplet discharge devices for discharging droplets of a liquid substance (functional liquid) onto a substrate or another surface are known as, for example, means for image drawing or various film-forming means. It is common for droplet discharge devices to discharge a plurality of functional liquids while switching among the liquids in accordance with the discharge target. Since the functional liquids differ in viscosity and other characteristics according to their type, the droplet discharge head is appropriately controlled according to the type of functional liquid so as to obtain the optimal discharge characteristics (see Japanese Laid-Open Patent Application No. 2003-21714, for example).

When this type of droplet discharge device is in a standby mode of not discharging droplets, the vibrating plate of the discharge head is made to undergo microvibration at a much lower amplitude than during droplet discharge in order to prevent the viscosity of the functional liquid in the discharge head from increasing. The frequency of these microvibrations is about several dozen kHz, for example.

When microvibrations are performed during standby of the discharge head, the viscosity increase of the functional liquid in the discharge head can be suppressed, but the behavior of the functional liquid causes the temperature of the discharge head to increase to the saturation temperature at the time of the microvibrations. When the discharge head then transitions from standby mode to drawing mode, the discharge head is cooled by the continuous supply of functional liquid, and the discharge head progressively converges toward the saturation temperature during discharge.

SUMMARY

However, in a conventional droplet discharge device having a plurality of functional liquids, when any of the functional liquids are used, uniform microvibrations are induced in the discharge head during standby. Therefore, the difference between the saturation temperature during microvibrations and the saturation temperature during discharge is sometimes severe due to the functional liquids having different characteristics, viscosity being a typical example, and there have been problems with the discharge characteristics being unstable.

Several aspects according to the present invention were contrived in view of the circumstances described above, and these aspects provide a method for controlling a droplet discharge device whereby a functional liquid can be discharged in a stable manner with predetermined discharge characteristics when any functional liquid is discharged in cases in which plural functional liquids having different characteristics are selectively discharged.

Also provided is a droplet discharge device capable of discharging a plurality of functional liquids having different characteristics in a stable manner with predetermined discharge characteristics.

To solve the problems described above, several aspects of the present invention provide the following method for controlling a droplet discharge device and droplet discharge device.

Specifically, a method according to a first aspect is for controlling a droplet discharge device including at least a droplet discharge head having a plurality of nozzles for discharging droplets of a functional liquid, a plurality of drive elements provided corresponding to each of the nozzles, and a vibrating plate which is vibrated by the drive elements to discharge the functional liquid from the nozzles; and a flushing unit in which the vibrating plate undergoes microvibration when the droplet discharge head is in a standby period. The method for controlling a droplet discharge device includes selecting one of a plurality of predetermined microvibration control programs for causing the vibrating plate to undergo microvibration in accordance with information relating to the functional liquid, and controlling the drive elements to cause the vibrating plate to undergo microvibration when the droplet discharge head is in the standby period in accordance with the selected microvibration control program.

The information relating to the functional liquid preferably includes viscosity information relating to the functional liquid.

The microvibration control of the vibrating plate preferably controls one of waveform, frequency, and voltage of a control current applied to the drive elements when the vibrating plate is subjected to microvibration.

The microvibration control of the vibrating plate preferably is a control performed so as to reduce a temperature difference between a saturation temperature during drawing of the functional liquid and a saturation temperature of the functional liquid when the vibrating plate is subjected to microvibration.

A droplet discharge device according to a second aspect includes a droplet discharge head, a flushing unit and a controller. The droplet discharge head has a plurality of nozzles for discharging droplets of a functional liquid, a plurality of drive elements provided corresponding to each of the nozzles, and a vibrating plate which is vibrated by the drive elements to discharge the functional liquid from the nozzles. The flushing unit is a unit in which the vibrating plate undergoes microvibration when the droplet discharge head is in a standby period. The controller is configured to control the droplet discharge head. The controller is further configured to select one of a plurality of predetermined microvibration control programs in accordance with information relating to the functional liquid, and to control the drive elements to cause the vibrating plate to undergo microvibration in accordance with the selected microvibration control program.

A droplet discharge device according to a third aspect includes a droplet discharge head, a work stage and a controller. A droplet discharge head has a nozzle, a drive element provided to the nozzle, and a vibrating plate vibrated by the drive element. The work stage is a stage on which a discharge target is placed. The controller is configured to control positions of the droplet discharge head and the work stage during a drawing mode to discharge droplets of a functional liquid from the nozzle onto the discharge target. The controller is further configured to select one of a plurality of predetermined vibration control programs in accordance with information relating to the functional liquid and to control the drive element, during a standby mode that is different from the drawing mode, to cause the vibrating plate to vibrate to a lesser degree than in the drawing mode in accordance with the selected vibration control program during a standby mode that is different from the drawing mode.

The information relating to the functional liquid preferably includes at least one of specific gravity, specific heat, and viscosity of the functional liquid.

The controller is preferably configured to select the predetermined microvibration control program in accordance with a temperature difference between a temperature of the droplet discharge head during the drawing mode and a temperature of the droplet discharge head during the standby mode.

The vibration control programs are preferably different from each other in at least one of waveform, frequency, and voltage of a control current applied to the drive element.

In the present invention, the standby mode may be a mode different from the drawing mode in which droplets of the functional liquid are discharged from the nozzle onto the discharge target. The standby mode may also be a mode in which the discharge target, e.g., a color filter substrate, is placed on or removed from the work stage, or a mode for adjusting the positional relationship between the discharge target and the droplet discharge head or the work stage. Furthermore, the standby mode may be a mode different from a mode for performing maintenance on the droplet discharge head or a mode for setting the droplet discharge device to a dormant state.

BRIEF DESCRIPTION OF THE DRAWINGS

Referring now to the attached drawings which form a part of this original disclosure.

DETAILED DESCRIPTION OF EXEMPLARY EMBODIMENTS

The preferred embodiments of the method for controlling a droplet discharge device and the droplet discharge device of the present invention are described hereinbelow. The present embodiment is described in detail in order to make the scope of the invention easier to understand, and the present embodiment does not limit the present invention inasmuch as there are no particular specifications. Some of the drawings used in the following description show enlarged views of significant portions for the sake of convenience in order to make the characteristics of the present invention easier to understand, and the dimensional ratios and other features of the constituent elements are not meant to be limited to those presented herein.

Figure 1:
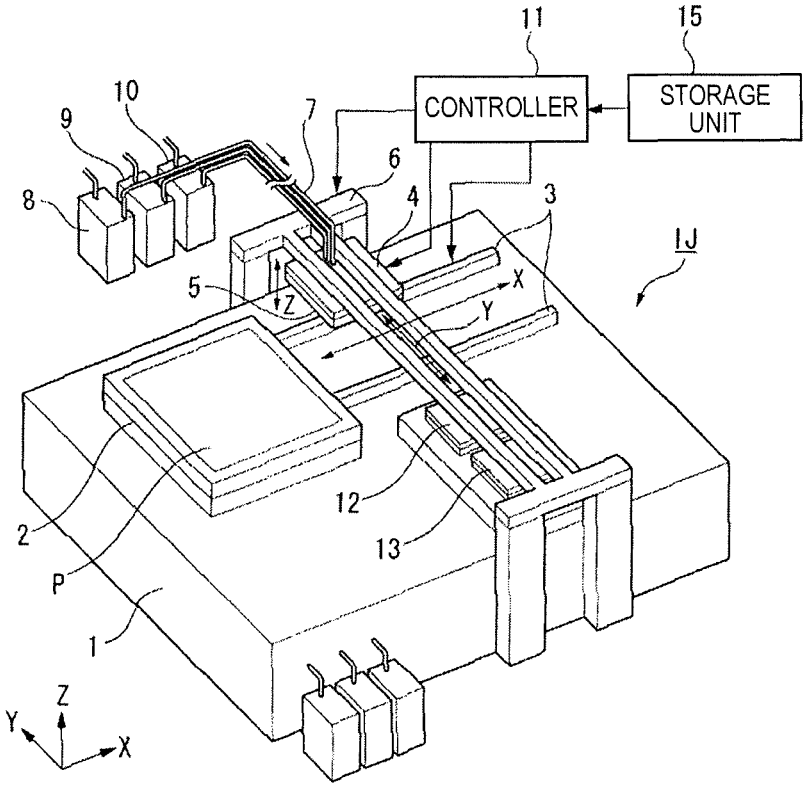
FIG. 1 is a perspective view showing an example of the droplet discharge device of the present invention.

FIG. 1 is a perspective view showing the schematic configuration of the droplet discharge device of the present invention. The droplet discharge device disposes functional liquid (hereinbelow referred to as a liquid substance) on a processed substrate by a droplet discharge method. The disposed liquid substance is, for example, a dispersed liquid (solution) or the like comprising a solid dispersed (dissolved) in a dispersion medium (solvent). Possible specific examples of the liquid substance include a color filter material including a pigment, a dye, or the like; a colloid solution including UV ink and metal particles as a material for forming an electroconductive film pattern for metal wiring or the like; and other examples.

In the present embodiment, a device which discharges droplets of a color filter material (functional liquid) onto a predetermined area of a color filter substrate P (discharge target) and forms a color filter layer is described as an example of a droplet discharge device which uses a liquid substance (functional liquid) such as the one previously described in a film material. In the following description, the XYZ orthogonal coordinate system shown in FIG. 1 is set up, and the components are described while referring to this XYZ orthogonal coordinate system. The XYZ orthogonal coordinate system in FIG. 1 is set up so that the X axis and the Y axis are parallel to the work stage 2, and the Z axis is orthogonal to the work stage 2. The XYZ coordinate system in FIG. 1 is also set up so that in effect, the XY plane is parallel to a horizontal plane and the Z axis is oriented in a vertical direction.

A droplet discharge device IJ comprises a device stand 1, a work stage 2, a stage movement device 3, a carriage 4, a droplet discharge head 5, a carriage movement device 6, a tube 7, a first tank 8, a second tank 9, a third tank 10, a controller 11, a flushing unit 12, a maintenance unit 13, and a storage unit (microvibration control table) 15, as shown in FIG. 1.

The device stand 1 is a support stand for the work stage 2 and the stage movement device 3. The work stage 2 is designed to be capable of being moved in the X-axis direction by the stage movement device 3 on the device stand 1, and a color filter substrate P (discharge target) conveyed from a conveyor device (not shown) upstream is held in the XY plane by a vacuum suction mechanism. The stage movement device 3 comprises ball screws, linear guides, or other bearing mechanisms, and causes the work stage 2 to move in the X-axis direction on the basis of a stage position control signal inputted from the controller 11 and indicating the X coordinates of the work stage 2.

The carriage 4 holds the droplet discharge head 5, and the carriage 4 is provided so as to be capable of being moved by the carriage movement device 6 in the Y-axis direction and the Z-axis direction. The droplet discharge head 5 comprises a plurality of nozzles as will be described hereinafter, and discharges droplets of a color filter material on the basis of drawing data or a drive control signal inputted from the controller 11.

Droplet discharge heads 5 are provided corresponding to the colors R (red), G (green), and B (blue) of the color filter material, and the droplet discharge heads 5 are linked with the tube 7 via the carriage 4. The droplet discharge head 5 corresponding to R (red) receives the supply of R (red) color filter material from a first tank 8 via the tube 7, the droplet discharge head 5 corresponding to G (green) receives the supply of G (green) color filter material from a second tank 9 via the tube 7, and the droplet discharge head 5 corresponding to B (blue) receives the supply of B (blue) color filter material from a third tank 10 via the tube 7.

Figure 2:
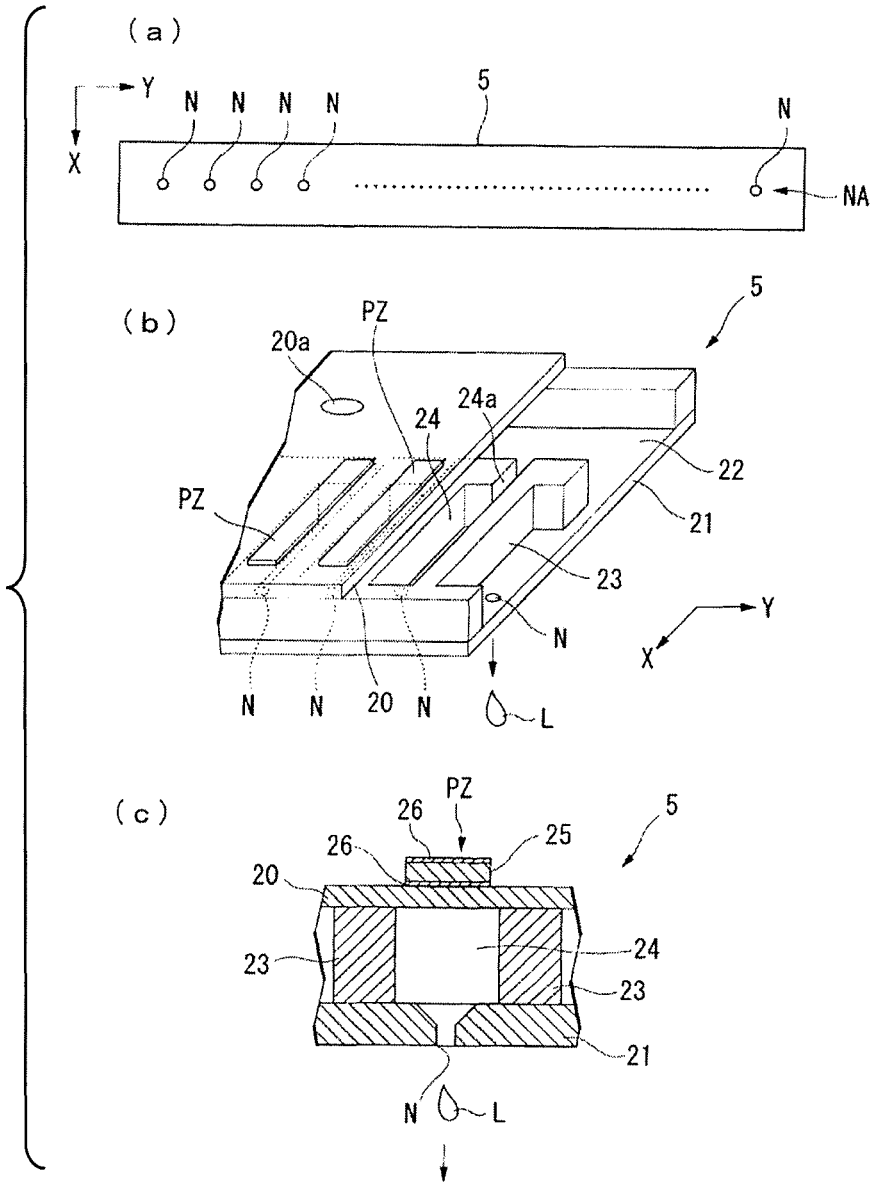
FIG. 2 is a partial structural view showing the droplet discharge head.

FIG. 2 is a schematic structural drawing of a droplet discharge head 5. FIG. 2(*a*) is a plan view of the droplet discharge head 5 as seen from the side having the work stage 2, FIG. 2(*b*) is a partial perspective view of the droplet discharge head 5, and FIG. 2(*c*) is a partial cross-sectional view of one nozzle of the droplet discharge head 5.

The droplet discharge head 5 comprises a plurality (e.g., 80) of nozzles N aligned in the Y-axis direction as shown in FIG. 2(*a*). A nozzle row NA is formed by the plurality of nozzles N. One row of nozzles is shown in FIG. 2(*a*), but the number of nozzles and number of nozzle rows provided to the droplet discharge head 5 can be changed as desired, and plural rows of nozzles aligned in the Y-axis direction may be aligned in the X-axis direction. The number of droplet discharge heads 5 disposed in the carriage 4 can also be changed as necessary. Furthermore, another option is a configuration in which a plurality of carriages 4 is provided as sub-carriage units.

The droplet discharge head 5 comprises a vibrating plate 20 provided with a material supply hole 20*a* linked with the tube 7, a nozzle plate (discharge surface) 21 to which the nozzles N are provided, a reservoir (liquid retainer) 22 provided between the vibrating plate 20 and the nozzle plate 21, a plurality of dividing walls 23, and a plurality of cavities (liquid chambers) 24, as shown in FIG. 2(*b*). The nozzle plate 21 is configured from SUS, for example. Piezoelectric elements (drive elements) PZ are disposed corresponding to the nozzles N on the vibrating plate 20. The piezoelectric elements PZ are piezo elements, for example.

The reservoir 22 is designed so as to be filled with a liquid color filter material (liquid substance), for example, which is supplied via the material supply hole 20*a*. The liquid substance is discharged after being selected from a plurality of liquid substances having different viscosities and other characteristics, for example, in accordance with the type of color filter substrate (target) which is the discharge target.

The cavities 24 are each formed so as to be enclosed by the vibrating plate 20, the nozzle plate 21, and a pair of dividing walls 23, and each cavity is provided corresponding to one of each of the nozzles N. The color filter materials (liquid substances) are selectively led into the cavities 24 from the reservoir 22 via supply ports 24*a* provided between each pair of dividing walls 23, in accordance with the type of color filter substrate (target).

Each of the piezoelectric elements PZ comprises a piezoelectric material 25 sandwiched between a pair of electrodes 26, and is configured so that the piezoelectric material 25 contracts when a drive signal is applied to the pair of electrodes 26, as shown in FIG. 2(*c*). The vibrating plate 20 on which the piezoelectric elements PZ are disposed is designed so as to flex outward (in the direction opposite the cavities 24) integrally and simultaneously with the piezoelectric elements PZ, whereby the capacities of the cavities 24 increase.

Therefore, an amount of color filter material equivalent to the increased capacity flows from the liquid retainer 22 into the cavities 24 via the supply ports 24*a*. In this state, when the drive signal ceases to be applied to the piezoelectric elements PZ, the piezoelectric elements PZ and the vibrating plate 20 return to their original shape, and the cavities 24 also return to their original capacity; therefore, the pressure of the color filter material in the cavities 24 increases, and droplets L of the color filter material are discharged from the nozzles N onto the color filter substrate P (discharge target).

The carriage movement device 6 has a bridge structure spanning across the device stand 1, for example, and comprises ball screws, linear guides, or other bearing mechanisms associated with the Y-axis direction and the Z-axis direction. The carriage movement device 6 causes the carriage 4 to move in the Y-axis direction and the Z-axis direction on the basis of a carriage position control signal inputted from the controller 11 and indicating the Y coordinates and Z coordinates of the carriage 4.

The tube 7 is a tube for supplying color filter material, and the tube links the first tank 8, the second tank 9, and the third tank 10 with the carriage 4 (the droplet discharge heads 5). The first tank 8 stores R (red) color filter material and also supplies color filter material to the droplet discharge head 5 corresponding to R (red) via the tube 7. The second tank 9 stores G (green) color filter material and also supplies color filter material to the droplet discharge head 5 corresponding to G (green) via the tube 7. The third tank 10 stores B (blue) color filter material and also supplies color filter material to the droplet discharge head 5 corresponding to B (blue) via the tube 7.

The controller 11 outputs a stage position control signal to the stage movement device 3, outputs a carriage position control signal to the carriage movement device 6, outputs drawing data and a drive control signal to a drive circuit board 30 of the droplet discharge head 5, and also performs synchronized control on the droplet discharge action by the droplet discharge head 5, the positioning action of the color filter substrate P (discharge target) by the movement of the work stage 2, and the positioning action of the droplet discharge head 5 by the movement of the carriage 4, whereby droplets of the color filter material are discharged onto a predetermined position on the color filter substrate P (the discharge target). During standby, described hereinafter, the controller 11 performs flushing a control in the flushing unit 12 as well as microvibration control. The microvibration control during standby will be described in detail hereinafter.

The flushing unit 12 is an area to which the droplet discharge head 5 retracts from above the work stage 2 at times such as when the color filter substrate P (discharge target) or another discharge target placed on the work stage 2 is being replaced (referred to as "standby" below). Performed in the flushing unit 12 is either the action of intermittently discharging a small amount of the liquid substance (functional liquid) from the droplet discharge head 5, or the action of inducing microvibrations in the liquid substance in the droplet discharge head 5 to an extent that does not cause the liquid substance (functional liquid) to be discharged. Viscosity increases in the liquid substance in the discharge head are prevented by these microvibrations. When microvibrations are performed, a drive signal is applied to the pair of electrodes 26 in the piezoelectric element PZ in FIG. 2(*c*). The amplitude of the drive signal in the case of performing microvibrations is lower than the amplitude of the drive signal in the case of performing discharge. In the case of performing microvibrations, the force applied to the liquid substance (functional liquid) in the nozzle N by the piezoelectric element PZ via the vibrating plate 20 is less than in the case of performing discharge. Consequently, when microvibrations are performed, the liquid substance (functional liquid) is not discharged, but the meniscus of the liquid substance (functional liquid) vibrates in the nozzle N.

The storage unit 15 (microvibration control table) stores a plurality of microvibration control programs for performing the microvibration action under different conditions in the flushing unit 12. Various microvibration control programs are prepared according to the types of liquid substances (functional liquids). Specifically, a plurality of microvibration control programs is stored so that the microvibrations of the droplet discharge head 5 in the flushing unit 12 are optimal according to the liquid substance discharged from the droplet discharge head 5. The microvibration control programs corresponding to the types (varieties) of discharged liquid substances are outputted from the controller 11. These different types of microvibration control programs may be prepared according to the characteristics of the liquid substances (functional liquids) discharged from the droplet discharge head 5. The characteristics of the liquid substances (functional liquids) include the viscosities, specific gravities, specific heats, and other characteristics of the liquid substances (functional liquids), for example. Furthermore, a plurality of microvibration control programs may be prepared according to the temperatures of the liquid substances (functional liquids). A plurality of microvibration control programs may be prepared according to the temperature of the droplet discharge head 5 particularly in cases in which the temperature of the droplet discharge head 5 is controlled when a liquid substance (functional liquid) is discharged.

The maintenance unit 13 is used to perform various types of maintenance on the droplet discharge head 5. The maintenance unit 13 is installed in a home position in the droplet discharge head 5. This home position is the area where the carriage 4 is placed when the droplet discharge head 5 is being managed and during other times when the droplet discharge device IJ is in a dormant state. The maintenance unit 13 includes capping means and wiping means which come in contact with, for example, the droplet discharge head 5. The capping means includes a suction pump as suction means, whereby a suction process is performed for forcefully discharging the liquid substance (functional liquid) from inside the nozzles. The wiping means performs a wiping process for wiping out droplets that have adhered to the nozzle plate (discharge surface) after the suction process is performed by the capping means. The maintenance unit 13 is driven by a control signal from the controller 11.

Figure 3:
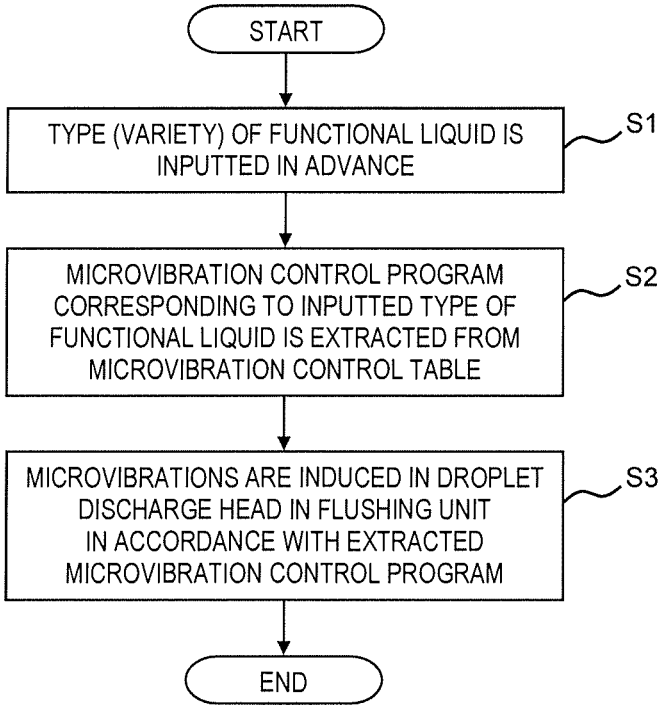
FIG. 3 is a flowchart showing the method for controlling a droplet discharge device of the present invention.

The action of the droplet discharge device of the present invention having the above-described configuration and the method for controlling the droplet discharge device of the present invention are described using FIGS. 1 and 3.

FIG. 3 is a flowchart showing the steps of the method for controlling a droplet discharge device of the present invention.

When the droplet discharge device IJ of the present invention is used to discharge a liquid substance (functional liquid) onto the color filter substrate (target) P and form a film (color filter layer), for example, the type (variety) of the functional liquid to be discharged is first inputted to the droplet discharge device IJ (S1: input step).

Possible examples of the information on the inputted type of functional liquid include the viscosity of the functional liquid, the specific gravity, the specific heat, and the like. The type (variety) of functional liquid including these pieces of information is inputted in advance to the droplet discharge device IJ as the functional liquid that will be supplied to the droplet discharge head 5 and discharged.

Next, the controller 11 of the droplet discharge device IJ refers to the storage unit (microvibration control table) 15, for example. The corresponding microvibration control program is then extracted based on the information on the type of functional liquid inputted in the input step S1 (S2: selection step). A number of microvibration control programs is preferably stored in proportion to the number of types (varieties) of functional liquids used (discharged) in the droplet discharge device IJ, for example.

The optimal microvibration control program may be created and outputted when the properties (viscosity, specific gravity, specific heat, etc.) of the functional liquid are inputted.

When the droplet discharge head 5 of the droplet discharge device IJ goes into standby mode and moves to the flushing unit 12 at times such as when the color filter substrate (target) P is being replaced, the droplet discharge head 5 discharged (flushes) a small amount of functional liquid in preparation for discharging the functional liquid onto the next color filter substrate P (discharge target). To prevent the viscosity of the functional liquid from increasing, the controller 11 induces microvibrations in the vibrating plate 20 (see FIG. 2) of the droplet discharge head 5 (S3: microvibration step) in accordance with the microvibration control program selected in the selection step S2.

This microvibration control program includes information on the waveform (microvibration waveform) which induces the microvibrations capable of suppressing viscosity increases during standby in accordance with the characteristics (e.g. viscosity) of the discharged functional liquid. The waveform applied for this microvibration waveform is a waveform which reduces the difference between the saturation temperature (standby saturation temperature) when the temperature of the discharge head is increased by microvibrations during standby, and the saturation temperature (drawing saturation temperature) when the discharge head has transitioned from standby mode to drawing mode and the discharge head has been cooled by the continuous supply of functional liquid or by another factor.

Figure 4:
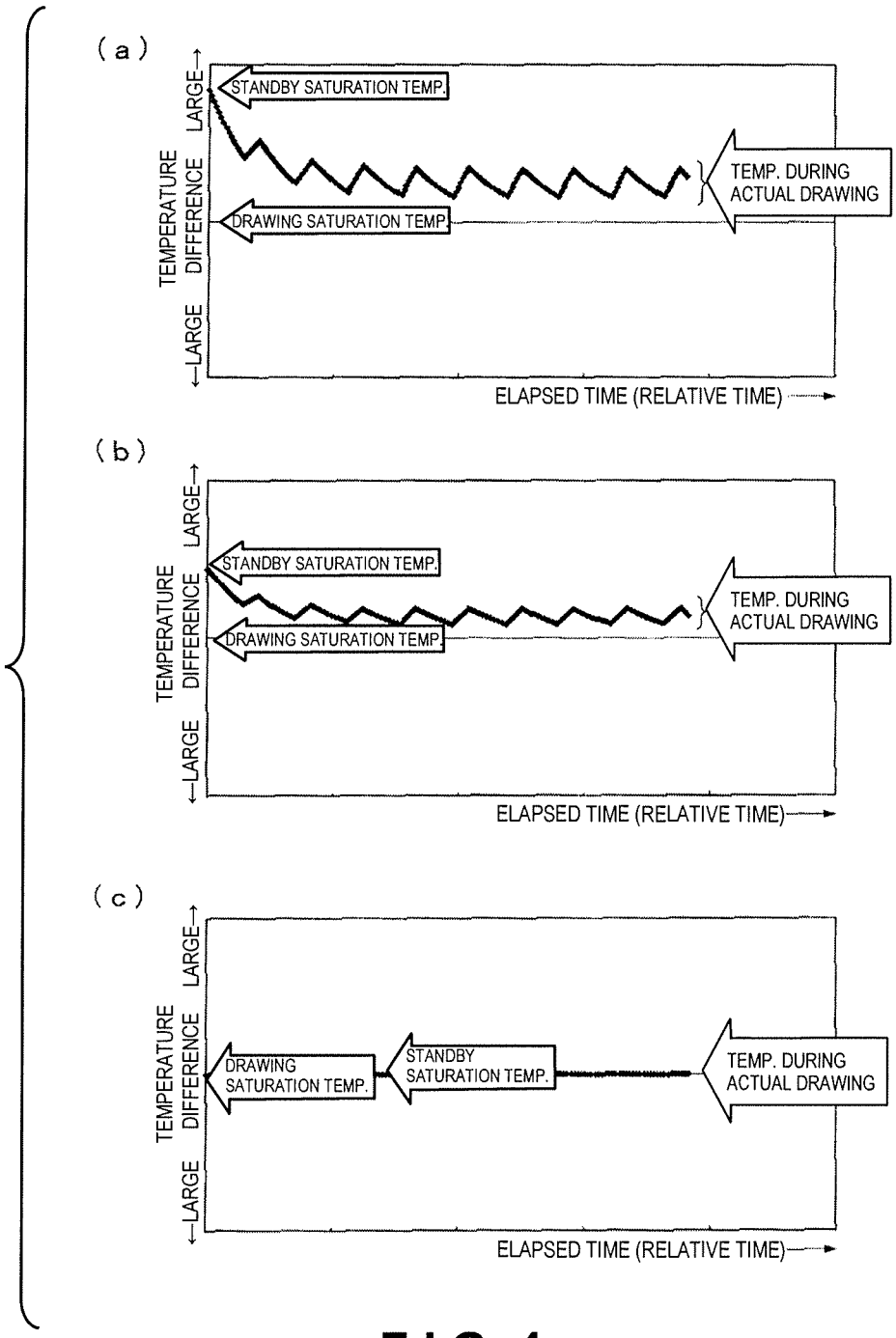
FIG. 4 is an illustrative diagram showing the manner of discharge in the case of framing a color filter.

FIG. 4 is a graph showing the manner in which the difference between the standby saturation temperature and the drawing saturation temperature is reduced by the selection and application of the optimal microvibration control program corresponding to the characteristics of the functional liquid.

The comparative example shown in FIG. 4(*a*) shows the temperature change in the droplet discharge head in a case in which a single (uniform) microvibration is induced in the droplet discharge head during standby without taking the characteristics of the functional liquid into account. The working example of the present invention shown in FIG. 4(*b*) shows the temperature change in the droplet discharge head in a case in which a microvibration control program is selected and applied and microvibrations are induced in the droplet discharge head during standby while taking the characteristics of the functional liquid into account.

The graphs in FIG. 4 show a case in which standby mode and drawing mode are repeated multiple times, wherein the vertical axes of the graphs represent the temperature difference in relation to the atmospheric saturation temperature, the drawing saturation temperature being a reference. The horizontal axes of the graphs represent the elapsed time (relative time) in a case in which standby mode and drawing mode are repeated multiple times.

The section Pr in the graph line represents the temperature change when droplets are discharged by the droplet discharge head, i.e., during drawing, and the section St represents the temperature change when microvibrations are induced while the droplet discharge head is in standby.

According to FIG. 4(*a*), in cases in which uniform microvibrations are induced in the droplet discharge head with any type of functional liquid without taking the type, i.e. the characteristics (e.g. viscosity) of the functional liquid into account, the temperature (section St) during microvibrations increases. As a result, the temperature change during drawing (section Pr) is severe when a transition is made from standby mode to drawing mode. This large temperature change during drawing affects the discharge characteristics and causes drawing discrepancies and the like due to fluctuations in the discharged amount and other factors.

According to FIG. 4(*b*), the optimal microvibration control program is selected and applied according to the type, i.e. the characteristics (e.g. viscosity) of the functional liquid, whereby the temperature increase during the microvibrations (section St) can be minimized. As a result, when a transition is made from standby mode to drawing mode, the temperature change during drawing (section Pr) also inevitably decreases, and the discharge characteristics during drawing become stable.

This type of microvibration control program is preferably a program for controlling the microvibrations of the droplet discharge head, ideally so that there is no difference between the standby saturation temperature and the drawing saturation temperature, as shown in FIG. 4(*c*).

Possible examples of the method for controlling the microvibrations of the droplet discharge head through the microvibration control program include controlling the waveform (pulse waveform), the frequency, the voltage value, and other characteristics of the control voltage applied to the droplet discharge head during standby. The microvibration control program preferably selects the waveform (pulse waveform), the frequency, and the voltage value of the control voltage for inducing microvibrations in the droplet discharge head during standby, in accordance with the type of the discharged functional liquid.

As described above, according to the method for controlling a droplet discharge device and the droplet discharge device of the present invention, the type, i.e. the characteristics (e.g. viscosity) of the functional liquid are inputted in advance, a microvibration control program that causes the difference between the standby saturation temperature and the drawing saturation temperature to maximally decrease is selected from the microvibration control table in accordance with the type of functional liquid, and microvibrations are induced in the droplet discharge head on the basis of this selected microvibration control program during standby. The temperature change in the droplet discharge head during drawing thereby decreases when a transition is made from standby mode to drawing mode, the discharge characteristics during drawing stabilize, and superior drawing characteristics can be obtained.

EXAMPLES

To verify the present invention, a test was conducted to confirm whether or not there was a change in the temperature during microvibrations in the droplet discharge head cases in which a change was made to the waveform (drive waveform) of the control current at which microvibrations were induced in the droplet discharge head.

Figure 5:
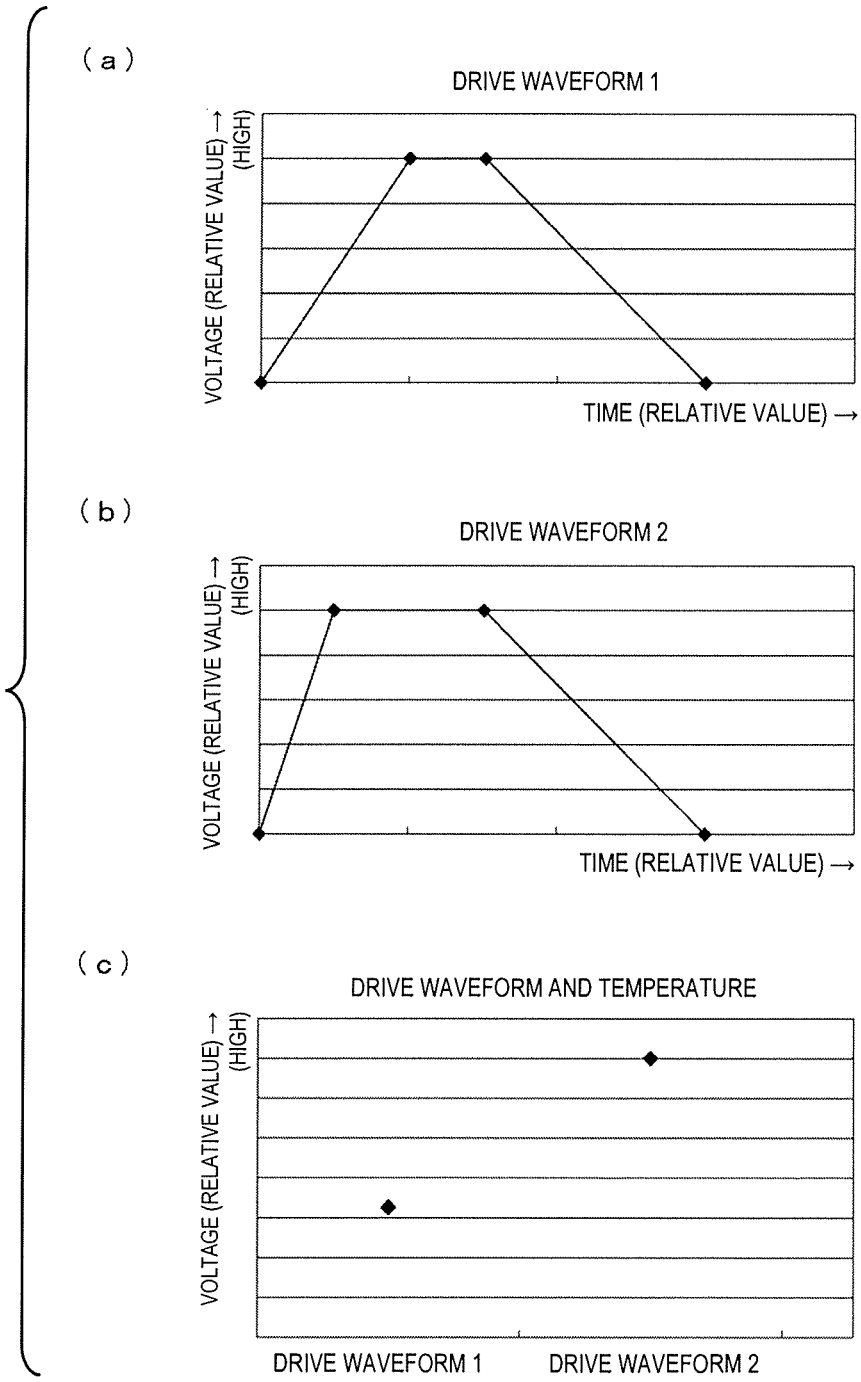
FIG. 5 is a graph showing an example of verifying the present invention.

For example, a microvibration control current of a drive waveform shown in FIG. 5(*a*) and a microvibration control current of a drive waveform shown in FIG. 5(*b*) were applied to the droplet discharge head, and the temperatures (relative values) of the droplet discharge head in both cases are shown in FIG. 5(*c*). According to the results shown in FIG. 5, the temperature of the droplet discharge head during microvibrations is much higher with the drive waveform of FIG. 5(*b*), which has a greater pulse width than FIG. 5(*a*).

Consequently, it was confirmed that the temperature (saturation temperature) of the droplet discharge head during microvibrations can be lowered and the difference with the drawing saturation temperature can be reduced by optimizing the pulse waveform of the microvibration control current.

To verify the present invention, a test was conducted to confirm whether or not there was a change in the temperature during microvibrations in the droplet discharge head cases in which a change was made to the waveform (drive waveform) of the control current at which microvibrations were induced in the droplet discharge head.

For example, a microvibration control current of a drive waveform shown in FIG. 5(*a*) and a microvibration control current of a drive waveform shown in FIG. 5(*b*) were applied to the droplet discharge head, and the temperatures (relative values) of the droplet discharge head in both cases are shown in FIG. 5(*c*). According to the results shown in FIG. 5, the temperature of the droplet discharge head during microvibrations is much higher with the drive waveform of FIG. 5(*b*), which has a greater pulse width than FIG. 5(*a*).

Consequently, it was confirmed that the temperature (saturation temperature) of the droplet discharge head during microvibrations (during standby) can be lowered and the difference with the drawing saturation temperature can be reduced by optimizing the pulse waveform of the microvibration control current.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A method for controlling a droplet discharge device including at least a droplet discharge head having a plurality of nozzles for discharging droplets of a functional liquid, a plurality of drive elements provided corresponding to each of the nozzles, and a vibrating plate which is vibrated by the drive elements to discharge the functional liquid from the nozzles; and a flushing unit in which the vibrating plate undergoes microvibration when the droplet discharge head is in a standby period, the method for controlling a droplet discharge device comprising:

selecting one of a plurality of predetermined microvibration control programs for causing the vibrating plate to undergo microvibration in accordance with information relating to the functional liquid so that a temperature difference between a saturation temperature of the functional liquid while the nozzles discharges the droplets of the functional liquid on a discharged target for drawing and a saturation temperature of the functional liquid while the vibrating plate is subjected to microvibration is reduced; and controlling the drive elements to cause the vibrating plate to undergo microvibration when the droplet discharge head is in the standby period in accordance with the selected microvibration control program.

2. The method for controlling a droplet discharge device according to claim 1, wherein the information relating to the functional liquid includes viscosity information relating to the functional liquid.

3. The method for controlling a droplet discharge device according to claim 1, wherein each of the microvibration control programs is configured to control one of waveform, frequency, and voltage of a control current applied to the drive elements when the vibrating plate is subjected to microvibration.

4. A droplet discharge device comprising:

a droplet discharge head having a plurality of nozzles for discharging droplets of a functional liquid, a plurality of drive elements provided corresponding to each of the nozzles, and a vibrating plate which is vibrated by the drive elements to discharge the functional liquid from the nozzles;

a flushing unit in which the vibrating plate undergoes microvibration when the droplet discharge head is in a standby period; and a controller configured to control the droplet discharge head, the controller being further configured to select one of a plurality of predetermined microvibration control programs in accordance with information relating to the functional liquid so that a temperature difference between a saturation temperature of the functional liquid while the nozzles discharges the droplets of the functional liquid on a discharged target for drawing and a saturation temperature of the functional liquid while the vibrating plate is subjected to microvibration is reduced, and to control the drive elements to cause the vibrating plate to undergo microvibration in accordance with the selected microvibration control program.

5. A droplet discharge device comprising:

a droplet discharge head having a nozzle, a drive element provided to the nozzle, and a vibrating plate vibrated by the drive element;

a work stage on which a discharge target is placed; and a controller configured to control positions of the droplet discharge head and the work stage during a drawing mode to discharge droplets of a functional liquid from the nozzle onto the discharge target, the controller being further configured to select one of a plurality of predetermined vibration control programs in accordance with information relating to the functional liquid so that a temperature difference between a saturation temperature of the functional liquid during the drawing mode and a saturation temperature of the functional liquid when the vibrating plate is subjected to microvibration is reduced, and to control the drive element, during a standby mode that is different from the drawing mode, to cause the vibrating plate to vibrate to a lesser degree than in the drawing mode in accordance with the selected vibration control program during a standby mode that is different from the drawing mode.

6. The droplet discharge device according to claim 5, wherein the information relating to the functional liquid includes at least one of specific gravity, specific heat and viscosity of the functional liquid.

7. The droplet discharge device according to claim 5, wherein the controller is configured to select one of the vibration control programs in accordance with a temperature difference between a temperature of the droplet discharge head during the drawing mode and a temperature of the droplet discharge head during the standby mode.

8. The droplet discharge device according to claim 5, wherein the vibration control programs are different from each other in at least one of waveform, frequency and voltage of a control current applied to the drive element.

* * * * *